US007396172B2

(12) United States Patent
Ong et al.

(10) Patent No.: US 7,396,172 B2
(45) Date of Patent: Jul. 8, 2008

(54) CARRIAGE PRELOADER AND CARRIAGE SYSTEM HAVING A PRELOADER

(75) Inventors: Ling-Hwee Ong, Singapore (SG); Ai-Meng Cheah, Singapore (SG); Hoong-Wai Wong, Singapore (SG); Wing-Kong Lo, Singapore (SG); Yew-Sia Liem, Singapore (SG); Raghuveer Mudambi Srinivasan, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 506 days.

(21) Appl. No.: 11/232,490

(22) Filed: Sep. 21, 2005

(65) Prior Publication Data

US 2007/0065214 A1 Mar. 22, 2007

(51) Int. Cl.
*B41J 11/22* (2006.01)

(52) U.S. Cl. ..... 400/354; 400/352; 347/37

(58) Field of Classification Search ..... 400/283, 400/336, 352, 354, 354.1, 354.2; 347/37, 347/39; 384/37, 38, 42
See application file for complete search history.

(56) References Cited

U.S. PATENT DOCUMENTS 4,576,496 A * 3/1986 Schwarz et al. ..... 400/352
4,714,354 A * 12/1987 Satomi ..... 384/38
4,744,686 A * 5/1988 Wakabayashi ..... 400/352
4,755,836 A 7/1988 Ta et al.
5,332,321 A * 7/1994 Beauchamp et al. ..... 400/354
5,366,305 A 11/1994 Christianson
5,596,241 A * 1/1997 Seki et al. ..... 310/323.07
6,310,638 B1 10/2001 Heiles et al.
6,629,788 B2 10/2003 Miranda et al.
6,663,302 B2 12/2003 Kelley et al.
6,672,696 B2 1/2004 Fairchild et al.
6,935,796 B2 * 8/2005 Johnson et al. ..... 400/354
2004/0052566 A1 3/2004 Johnson et al.

FOREIGN PATENT DOCUMENTS

EP 0953456 3/1999

* cited by examiner

*Primary Examiner*—Daniel J. Colilla
*Assistant Examiner*—Kevin D Williams

(57) ABSTRACT

A carriage system for a printing apparatus is disclosed. The carriage system includes a movable carriage for carrying at least one ink pen, a carriage rod on which the carriage is rotatably mounted, an anti-rotation rail that is adjacent to one end of the carriage to prevent the rotation of the carriage in one direction, and a spring-loaded preloader coupled to an underside of the carriage to prevent the rotation of the carriage in the opposite direction and to urge the carriage against the anti-rotation rail. The preloader includes a preloader body made of a nonmetallic material, a roller operable to roll along a surface below the carriage, and a resilient spring.

11 Claims, 6 Drawing Sheets

CARRIAGE PRELOADER AND CARRIAGE SYSTEM HAVING A PRELOADER

FIELD OF THE INVENTION

The present invention relates generally to carriage drive systems for printing apparatuses and more particularly to a carriage preloader and carriage system having the same.

BACKGROUND

In many conventional printing apparatuses, such as inkjet printers, a pen carriage is moved relative to the print medium to perform printing. The carriage carries one or more ink cartridges (called "pen" by those in the art), which eject ink drops onto the print medium during printing. Typically, the carriage glides (or "scans") back and forth on a carriage rod that is mounted substantially orthogonal to the moving direction of the print medium. Some inkjet printers further include an anti-rotation mechanism to limit the rotational movement of the carriage about the carriage rod axis. One known anti-rotation mechanism is in the form of an anti-rotational roller mounted under the front end of the carriage. This type of roller runs along a track surface below the carriage during printing to prevent the carriage from rotating about the guide rod axis.

Another anti-rotation mechanism is in the form of an elongated guide or rail arranged parallel to the guide rod and adjacent to a distal end of the carriage. In inkjet printing, it is important that the carriage glides smoothly along the guide rod with minimum vibration so that ink dots can be accurately placed on the print medium. As printing speed increases, the tendency for the carriage to rock about the guide rod increases. The prior art anti-rotation mechanisms are not sufficient to prevent uncontrolled rocking of the carriage during high-speed printing, e.g. at 60 ips or more. There exists a need for a carriage system with mechanisms that are low-cost yet effective for stabilizing the carriage dynamics during printing, especially during high-speed printing.

SUMMARY

The present invention provides a carriage system for a printing apparatus. The carriage system includes a movable carriage for carrying at least one ink pen, a carriage rod on which the carriage is rotatably mounted, an anti-rotation rail that is adjacent to one end of the carriage to prevent the rotation of the carriage in one direction, and a spring-loaded preloader coupled to an underside of the carriage to prevent the rotation of the carriage in the opposite direction and to urge the carriage against the anti-rotation rail. The preloader includes a preloader body made of a nonmetallic material, a roller operable to roll along a surface below the carriage, and a resilient spring.

The objects and advantages of the present disclosure will become apparent from the detailed description when read in conjunction with the drawings.

DETAILED DESCRIPTION

Figure 1:
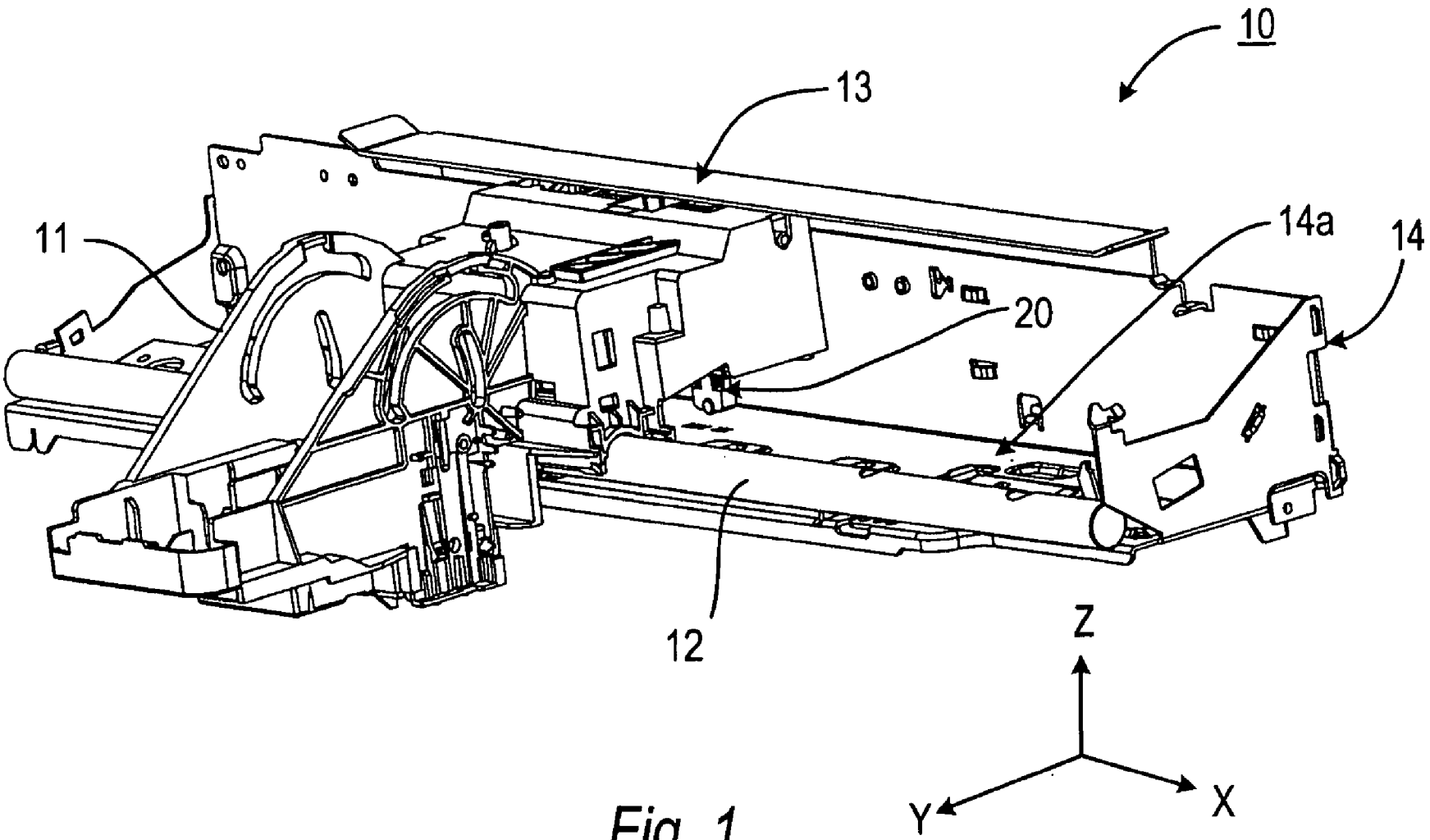
FIG. 1 shows an isometric view of a carriage system in accordance with an embodiment of the present invention.

FIG. 1 is an isometric view showing a carriage system 10 in accordance with an embodiment. The carriage system 10 is suitable for use in an inkjet printer. The term "inkjet printer" is intended to encompass all imaging systems that utilize inkjet printing technology, such as computer printers, copiers, facsimile machines, and graphic plotters. The carriage system 10 includes: a carriage 11 that is rotatably mounted on a carriage rod 12; an anti-rotation rail 13 mounted to a hanger 14; and a preloader 20 coupled to an underside of the carriage 11. The carriage 11 is configured to hold one or more ink pens or cartridges (not shown) and is movable along the carriage rod 12 in a reciprocating manner. The hanger 14 is a frame structure with a bottom surface 14*a* that defines a rolling surface for the preloader 20. The preloader 20 is configured to roll along the bottom surface 14*a* of the hanger 14 when the carriage is moving. During printing, the carriage 11 scans back and forth above a print medium in an X direction as the print medium is advanced in a Y direction that is orthogonal to the carriage rod 12.

Figure 2:
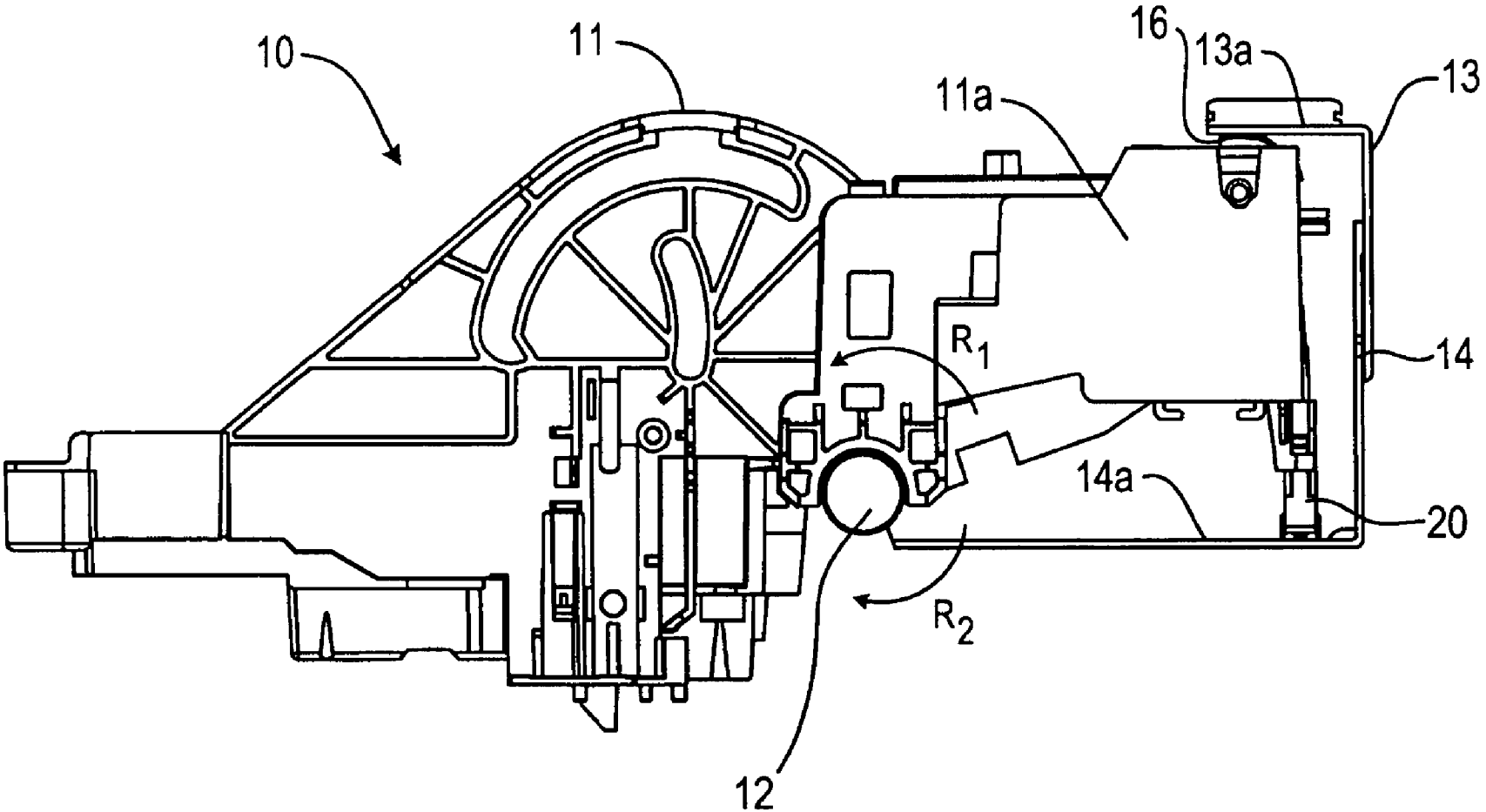
FIG. 2 shows a side view of the carriage system shown in FIG. 1.

FIG. 2 shows a side view of the carriage system 10. As shown in FIG. 2, the anti-rotation rail 13 is mounted to the back wall of the hanger 14 and is arranged to be adjacent to a back end 11*a* of the carriage 11. The anti-rotation rail 13 has a lateral flange portion 13*a* that defines a sliding surface for the back end 11*a* of the carriage. The back end 11*a* of the carriage 11 is further provided with a slider 16, which is adapted for sliding along the bottom surface of the flange portion 13*a*. The anti-rotation rail 13 serves to prevent the rotational movement of the carriage about the carriage rod axis in the direction indicated by arrow $R_1$ while the preloader 20 serves to prevent the rotation of the carriage in the downward direction indicated by arrow $R_2$. The preloader also serves to urge the carriage 11 upward against the lateral flange portion 13*a* of the anti-rotation rail 13. The anti-rotation rail 13 can be adjusted upwardly or downwardly in order to orient the carriage 11 to a predetermined position that provides a predetermined pen-to-paper spacing. Any conventional adjusting mechanism known in the art may be used for adjusting the anti-rotation rail. The combination of the carriage rod 12, the anti-rotation rail 13, and the preloader 20 provides a carriage support system with increased lateral stability.

Figure 3:
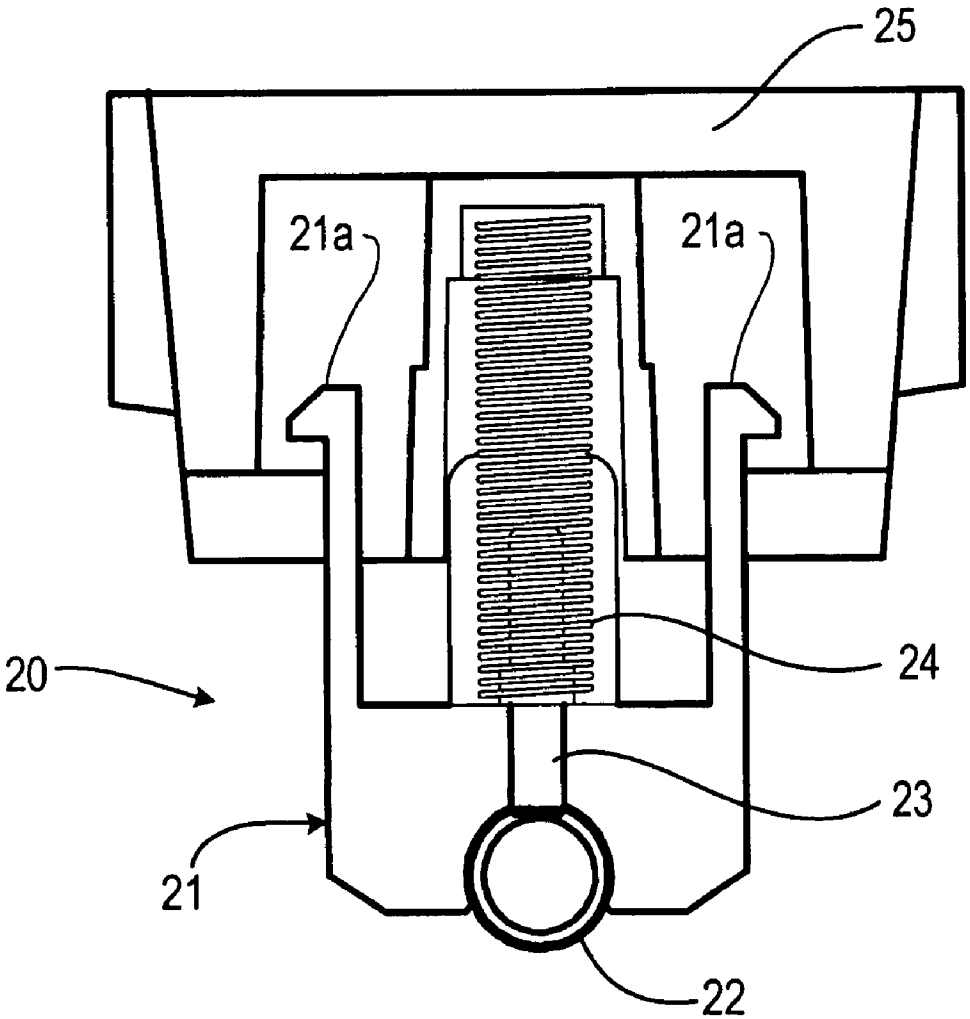
FIG. 3 shows a partially cut-away view of a carriage preloader in accordance with an embodiment of the present invention.
Figure 4:
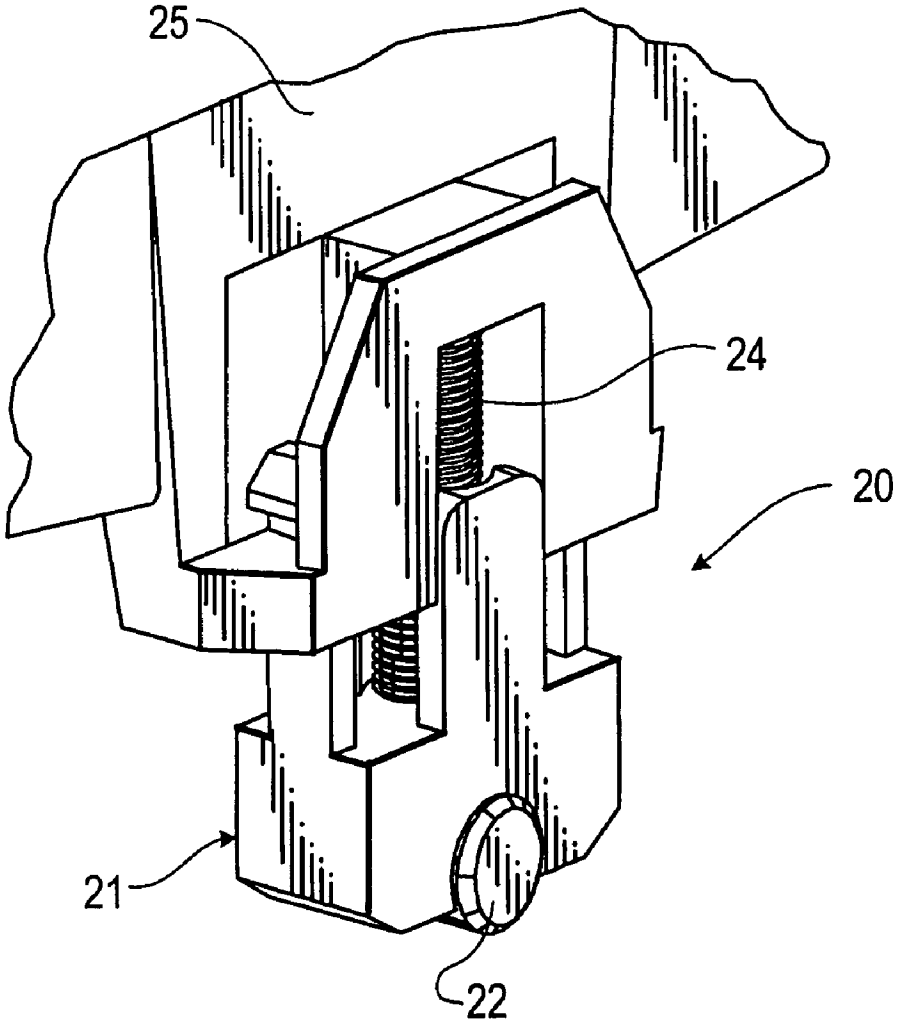
FIG. 4 shows an isometric view of the carriage preloader and a mounting bracket for the preloader in accordance with an embodiment of the present invention.
Figure 5:
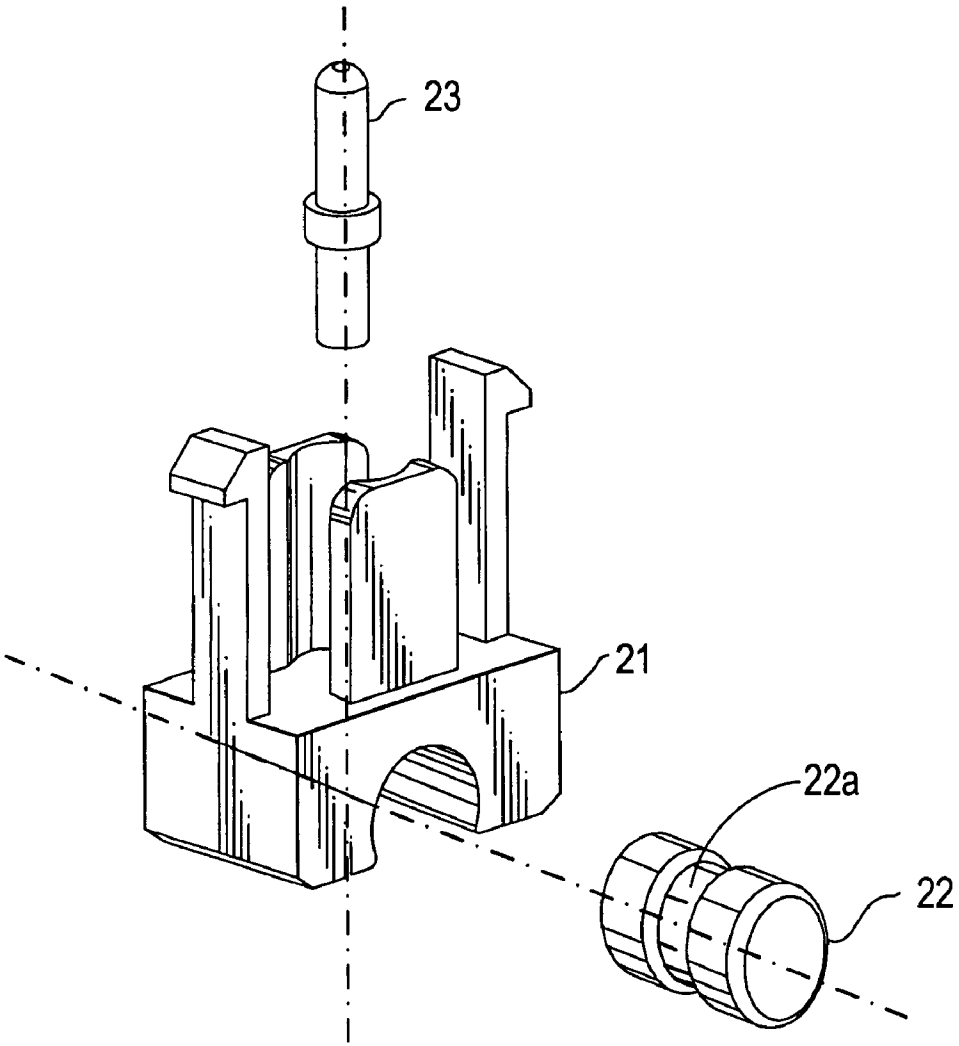
FIG. 5 shows the components of the carriage preloader in a disassembled state in accordance with an embodiment of the present invention.

Details of the preloader 20 are shown in FIGS. 3-5. FIG. 3 shows a partially cut-away view of the preloader 20. Referring to FIG. 3, the preloader 20 includes a preloader body 21, a roller 22, a collar 23, and a coil spring 24. The preloader body 21 is shaped so that a concave recess is formed at the bottom section for receiving the roller 22 and a through hole is formed above the concave recess for receiving the collar 23 such that one end of the collar 23 is in contact with the roller 22. The preloader body 21 has two hook arms 21*a* for hooking the preloader body to a mounting bracket 25, whereby the preloader body 21 is movably held in place by the mounting bracket 25. The coil spring 24 is compressed between the mounting bracket 25 and the preloader body 21.

By this arrangement, the coil spring 24 applies a biasing force vertically relative to the surface on which the roller rolls, i.e. the bottom surface 14*a* of hanger 14 shown in FIG. 1. The mounting bracket 25 is configured to couple the preloader 20 to the underside of the carriage 11. FIG. 4 shows an isometric view of the preloader 20 and the mounting bracket 25. The preloader body 21 and the collar 23 may be made of a nonmetallic material that is relatively tough, such as thermoplastic. An example of a suitable thermoplastic material is polyphenylene oxide (or PPO). The roller 22 may be made of a polymeric material that has a low coefficient of friction, such as polyoxymethylene (or POM). The coil spring 24 may be made of metal.

FIG. 5 shows the preloader body 21, the roller 22 and the collar 23 in a disassembled state. As shown in FIG. 5, the roller 22 has a slotted middle section 22*a* for engaging one end of the collar 23. In this way, the collar 23 functions as a means for preventing the roller 22 from sliding out of the preloader body 21. The roller 22 and the collar 23 are designed so that they can be readily inserted into place without additional mounting or joining mechanisms.

Figure 6:
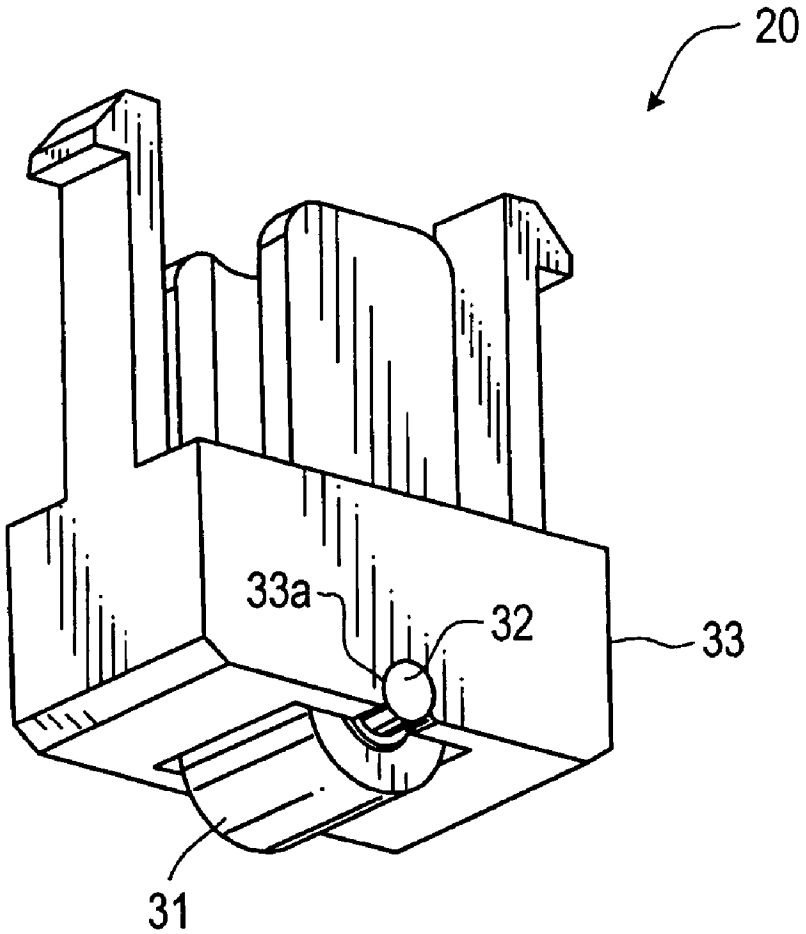
FIG. 6 shows an alternative design for the carriage preloader in accordance with another embodiment of the present invention.

FIG. 6 shows an alternative embodiment for the preloader 20. In this embodiment, the preloader 20 includes a roller 31 that is rotatably mounted on a shaft 32. The preloader body 33 has a concave recess for receiving the roller 31 and two U-shaped slots 33*a* for receiving the ends of the shaft 32. The shaft 32 is attached to the preloader body 33 by a snap-fit joining system, whereby the ends the shaft are snapped into the U-shape slots 33*a* that are formed in the preloader body. One advantage of the roller system shown in FIG. 6 is that the friction between the preloader body 33 and the roller 31 is greatly reduced.

By having a carriage system with a preloader as described above, the impact of frictional forces during carriage scanning is minimized. Consequently, the current for driving the carriage during printing is greatly reduced. Furthermore, the preloader is spring-loaded and has a flexible body so that it can be self-adjusted to accommodate variations in the dimensions of the carriage system due to imperfections in both part shaping and system-level assembly processes. Another advantage of the preloader is that it can be fabricated at low cost because it requires few parts and the parts can be easily assembled and disassembled. Furthermore, the parts are small, thus, they do not add bulkiness to the printer.

It is intended that the embodiments contained in the above description and shown in the accompanying drawings are illustrative and not limiting. It will be obvious to those skilled in the art that various modifications may be made to these embodiments without departing from the scope of the invention as defined by the appended claims.

What is claimed is:

1. A carriage system for a printing apparatus comprising:

a movable carriage for carrying at least one ink pen;

a carriage rod on which the carriage is rotatably mounted;

an anti-rotation rail that is adjacent to one end of the carriage to prevent the rotation of the carriage in one direction; and a spring-loaded preloader coupled to an underside of the carriage for preventing the rotation of the carriage in the opposite direction and to urge the carriage against the anti-rotation rail, wherein the preloader comprises a preloader body made of a nonmetallic material, a roller operable to roll along a surface below the carriage, and a resilient spring.

2. The carriage system of claim 1 further comprising:

a frame structure having a back wall and a bottom surface, wherein the anti-rotation rail is mounted to the back wall of the frame structure, and the bottom surface of the frame structure defines the surface on which the roller rolls.

3. The carriage system of claim 1, wherein the anti-rotation rail is positioned adjacent to a back end of the carriage, and the preloader is coupled to the underside of said back end.

4. The carriage system of claim 3 further comprising a slider mounted on the back end of the carriage, and the anti-rotation rail comprises a flange portion that defines a sliding surface for the slider.

5. The carriage system of claim 1, wherein the preloader body is made of a thermoplastic material.

6. The carriage system of claim 1, wherein the resilient spring is a metal coil spring.

7. The carriage system of claim 1 further comprising a mounting bracket for coupling the preloader to the underside of the carriage, and wherein the resilient spring is compressed between the mounting bracket and the preloader body.

8. The carriage system of claim 7, wherein the preloader body is configured to have hook arms, which hook the preloader body to the mounting bracket.

9. The carriage system of claim 1, wherein:

the roller has a slotted middle section, and the preloader further comprises a collar that engages with the slotted middle section, and the preloader body is shaped so that a concave recess is formed at the bottom section for receiving the roller and a through hole is formed above the concave recess for receiving the collar, whereby the engagement between the collar and the slotted middle section of the roller prevents the roller from sliding out of the preloader body when the roller is rolling.

10. The carriage system of claim 1, wherein:

the preloader body is shaped so that a concave recess is formed at the bottom section for receiving the roller, and the roller is rotatably mounted on a shaft, which is attached to the preloader body.

11. The carriage system of claim 1, wherein the anti-rotation rail is adjustable upwardly or downwardly.

* * * * *